US005657729A

United States Patent [19]

Atmur et al.

[11] Patent Number: 5,657,729

[45] Date of Patent: Aug. 19, 1997

[54] FIBER REINFORCED CERAMIC MATRIX COMPOSITE CYLINDER HEAD AND CYLINDER HEAD LINER FOR AN INTERNAL COMBUSTION ENGINE

[75] Inventors: Steven Donald Atmur, Riverside; Thomas Edward Strasser, Corona, both of Calif.

[73] Assignee: Northrop Grumman Corporation, Los Angeles, Calif.

[21] Appl. No.: 515,889

[22] Filed: Aug. 16, 1995

[51] Int. Cl.[6] ..... F02B 75/18

[52] U.S. Cl. ..... 123/193.5; 123/41.69; 123/41.72

[58] Field of Search ..... 123/193.5, 193.2, 123/41.56, 41.69, 41.72, 41.82 R

[56] References Cited

U.S. PATENT DOCUMENTS

| | | | |
|---|---|---|---|
| 3,659,568 | 5/1972 | Howe | 123/41.69 |
| 3,880,969 | 4/1975 | Latos | 264/44 |
| 4,067,829 | 1/1978 | Garrett | 260/60 |
| 4,206,598 | 6/1980 | Rao et al. | 60/282 |
| 4,207,660 | 6/1980 | Rao et al. | 60/322 |
| 4,216,746 | 8/1980 | Freyn | 123/41.69 |
| 4,222,360 | 9/1980 | Fujikawa et al. | 123/41.69 |
| 4,233,361 | 11/1980 | Fultz | 428/313 |
| 4,245,611 | 1/1981 | Mitchell et al. | 123/669 |
| 4,294,788 | 10/1981 | Laskow et al. | 264/101 |
| 4,311,541 | 1/1982 | Fultz et al. | 156/78 |
| 4,341,826 | 7/1982 | Prewo et al. | 428/35 |
| 4,601,264 | 7/1986 | Hirano | 123/41.27 |
| 4,606,434 | 8/1986 | Vasilow et al. | 188/1.11 |
| 4,657,951 | 4/1987 | Takarada et al. | 523/153 |
| 4,781,157 | 11/1988 | Wade et al. | 123/41.71 |
| 4,791,896 | 12/1988 | Bidwell | 123/41.83 |
| 4,818,732 | 4/1989 | Fox et al. | 501/81 |
| 4,848,292 | 7/1989 | Holtzberg | 123/193.3 |
| 4,884,400 | 12/1989 | Tanaka et al. | 60/323 |
| 4,887,518 | 12/1989 | Hayakawa | 92/212 |
| 4,911,109 | 3/1990 | Kawamura et al. | 123/41.74 |
| 4,928,645 | 5/1990 | Berneburg et al. | 251/368 |
| 4,972,674 | 11/1990 | Yamada et al. | 60/323 |
| 4,981,820 | 1/1991 | Renlund et al. | 501/39 |
| 5,000,136 | 3/1991 | Hansen et al. | 123/307 |
| 5,018,661 | 5/1991 | Cyb et al. | 228/176 |
| 5,063,881 | 11/1991 | Kawamura | 123/1 A |
| 5,094,200 | 3/1992 | Fontichiaro | 123/188.3 |
| 5,114,262 | 5/1992 | Kojima | 92/187 |
| 5,126,087 | 6/1992 | Lespade et al. | 264/60 |
| 5,137,789 | 8/1992 | Kaushal | 428/472 |
| 5,140,813 | 8/1992 | Whittenberger | 60/300 |
| 5,152,259 | 10/1992 | Bell | 123/80 R |
| 5,180,694 | 1/1993 | Renlund et al. | 264/65 |
| 5,203,228 | 4/1993 | Miyawaki et al. | 123/197.4 |
| 5,224,335 | 7/1993 | Yoshizaki | 60/300 |
| 5,224,572 | 7/1993 | Smolen, Jr. et al. | 428/472 |
| 5,225,283 | 7/1993 | Leung et al. | 428/408 |
| 5,231,059 | 7/1993 | Leung et al. | 65/901 |
| 5,244,720 | 9/1993 | Leung et al. | 428/266 |
| 5,258,084 | 11/1993 | Leung et al. | 156/89 |
| 5,404,721 | 4/1995 | Hartsock | 60/300 |
| 5,421,292 | 6/1995 | Hoffman et al. | 123/41.69 |
| 5,477,820 | 12/1995 | Rao | 123/193.2 |

*Primary Examiner*—David A. Okonsky

*Attorney, Agent, or Firm*—Terry J. Anderson; Karl J. Hoch, Jr.

[57] ABSTRACT

A ceramic cylinder head or cylinder head liner for an internal combustion engine. The cylinder head is made of a fiber reinforced ceramic matrix composite material and includes a heat sink on the top surface to keep touch temperatures at a reasonable level. The preferred embodiment employs water cooling so as to reduce engine compartment temperatures and provide a supply of hot water for passenger compartment heating.

17 Claims, 2 Drawing Sheets

FIBER REINFORCED CERAMIC MATRIX COMPOSITE CYLINDER HEAD AND CYLINDER HEAD LINER FOR AN INTERNAL COMBUSTION ENGINE

BACKGROUND OF THE INVENTION

1. Technical Field

This invention relates to components of internal combustion engines and, more particularly, to an all ceramic cylinder head or a fiber reinforced ceramic matrix composite liner for internal combustion engine comprising a cylinder head made of structural fiber reinforced ceramic matrix composite.

2. Background Art

A typical internal combustion engine comprises an engine block containing one or more cylinders in which pistons move up and down as the result of the burning of fuel therein. The cylinders are covered and closed by a cylinder head 10 as shown in FIGS. 1 and 2. The burning of the fuel under compression releases energy as motion and heat. Accordingly, the parts of the engine tend to get very hot. To prevent metal damage from over-heating and problems of lubrication break-down and possible engine seizure from excessive thermal expansion of parts, the heat must be conducted away so as to limit the operating temperature of the engine to design standards. This is normally done in one of two ways. As shown in FIG. 1, the cylinder head 10 can have a water jacket 12 built into it wherein the water jacket 12 is connected via the connecting tubes 30, 32 to the water circulated through the block and an air-cooled radiator. As shown in FIG. 2, the cylinder head 10 can incorporate fins 14 which provide a large surface area to radiate heat directly to air passing therethrough. Motorcycles, lawnmowers, and the like, tend to use the fins 14 while automobile and truck engines favor a water jacket 12 due to the high heat loads generated in their operating environment in conjunction with allowable under-hood temperature requirements. In addition, the water jacket 12 provides a heat source for the vehicle's heating, ventilation and air conditioner (HVAC) system.

In a co-pending application entitled HIGH-EFFICIENCY, LOW POLLUTION ENGINE by the inventors herein, Ser. No. 08/515,604, filed on Aug. 16, 1995 and assigned to the common assignee of this application, an improved structural fiber reinforced ceramic matrix composite (FRCMC) material is disclosed having high breakage resistance and particular applicability to use for parts in a high temperature internal combustion engine the teachings of which are incorporated herein by reference. A novel engine design employing parts made of that FRCMC material is also disclosed. The engine runs at very high temperatures so as to improve fuel efficiency and reduce the emission of unburned pollutants. While one could employ a ceramic-lined metal cylinder head with that engine according to techniques disclosed in the co-pending application entitled METHODS AND APPARATUS FOR MAKING CERAMIC MATRIX COMPOSITE LINED AUTOMOTIVE PARTS AND FIBER REINFORCED CERAMIC MATRIX COMPOSITE AUTOMOTIVE PARTS by the inventors herein, Ser. No. 08/515,849, filed on Aug. 16, 1995 and assigned to the common assignee of this application, it would be preferable to have the entire cylinder head made of the FRCMC material or a liner formed from the FRCMC material. While the ceramic engine is not as prone to thermal damage as a metal engine, an un-cooled ceramic cylinder head being at the top of the engine block and directly under the hood of the automobile would most likely achieve unacceptable "touch" temperatures, which would lead to unreasonable engine compartment temperatures and possible even destroy the paint on the hood. Thus, for entirely different reasons, the reduction of heat at least at the outer surface of a ceramic cylinder head remains a problem to be dealt with. Moreover, automobiles and trucks still favor a hot water passenger compartment heating system over the alternatives such as hot air or burned fuel heaters.

Wherefore, it is an object of the present invention to provide a ceramic cylinder head or headliner fabricated of a structural fiber reinforced ceramic matrix composite material for an internal combustion engine which includes provision for reducing its temperature level at the outer surface thereof.

It is another object of the present invention to provide a ceramic cylinder head or headliner fabricated of a structural fiber reinforced ceramic matrix composite material for an automobile which can be positioned under an automobile hood without damaging other vehicle systems from radiated heat.

It is still another object of the present invention to provide a ceramic cylinder head or headliner fabricated of a structural fiber reinforced ceramic matrix composite material for an automobile which provides or allows for hot water for a passenger compartment heating system.

Other objects and benefits of this invention will become apparent from the description which follows hereinafter when read in conjunction with the drawing figures which accompany it.

SUMMARY OF THE DISCLOSURE

The foregoing objects have been achieved by the ceramic cylinder head and ceramic head liner for an internal combustion engine of the present invention comprising a cylinder head made of a generic fiber system disposed throughout a pre-ceramic resin in its ceramic state and means for transferring heat from the cylinder head.

In the preferred embodiment, the means for transferring heat from the cylinder head will depend on the specific application for which the engine is designed. Motorized vehicle applications typically include the use of a liquid cooling system to remove excess heat from the head which also provides a heat source for the passenger compartment heating system, while small utility engines are typically air cooled.

In one embodiment, the means for transferring heat from the cylinder head comprises radiating fins formed in the top surface of the cylinder head for transferring heat to air surrounding the fins.

In another embodiment, the means for transferring heat from a top surface of the cylinder head comprises a metal heat sink attached to the top surface, the heat sink including radiating fins for transferring heat to air surrounding the fins.

In one embodiment for producing hot water as a by-product, the means for transferring heat from the cylinder head comprises a metal water jacket formed onto the top surface wherein the water jacket has an inlet pipe and an outlet pipe for passing engine coolant or some other fluid used in the passenger compartment heating system therethrough. This embodiment can be cast directly onto the ceramic cylinder head.

The fourth embodiment is a bonded in FRCMC cylinder head liner for use in a water cooled cylinder head.

The fifth embodiment is a mechanically trapped FRCMC cylinder head liner for air cooled cylinder head applications.

DETAILED DESCRIPTION OF THE PREFERRED EMBODIMENT

Figure 1:
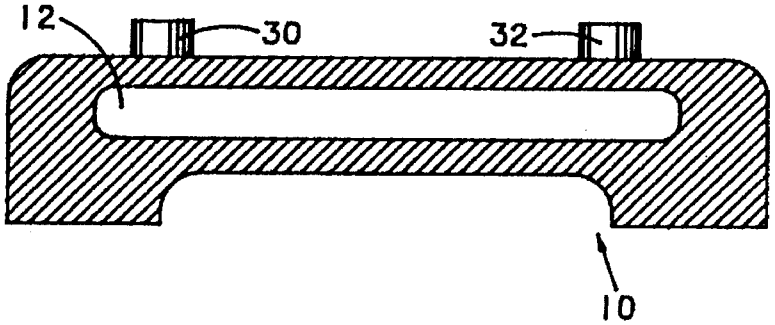
FIG. 1 PRIOR ART
FIG. 1 is a simplified cross section of a prior art cylinder head with a water jacket incorporated therein, representative of typical automotive applications.
Figure 2:
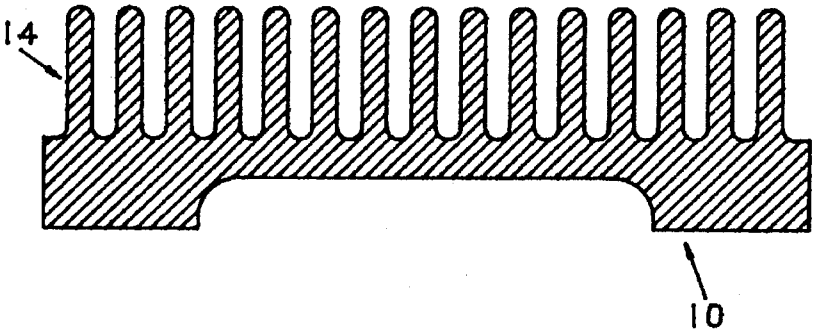
FIG. 2 PRIOR ART
FIG. 2 is a simplified cross section of a prior art cylinder head with air-cooling fins incorporated therein, typical in small utility engine applications.
Figure 3:
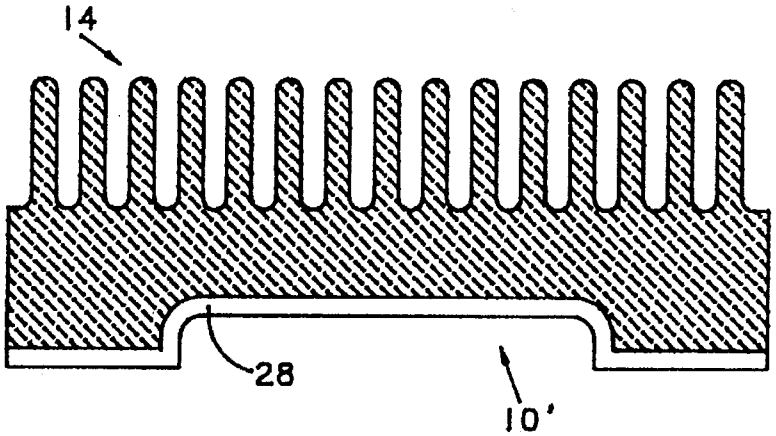
FIG. 3 is a simplified cross section of a ceramic cylinder head with integral air-cooling fins incorporated therein according to a first embodiment of the present invention.

In one embodiment of the present invention as depicted in FIG. 3, a cylinder head 10' is formed out of a structural fiber reinforced ceramic matrix composite material as disclosed in any of the above-referenced or other co-pending applications of the co-inventors herein. In particular, the cylinder head 10' can be made of a structural fiber reinforced ceramic matrix composite material comprising a polymer-derived ceramic resin or a cementatous resin that has been modified to emulate polymer composite processing techniques having fibers of a generic fiber system disposed throughout. The preferred FRCMC material employs any of several pre-ceramic resins commercially available such as Silicon-Carboxyl resin (sold by Allied Signal under the trade name Blackglas), Alumina Silicate resin (sold by Applied Poleramics under the product designation CO2), or Monoaluminum Phosphate (also known as Monoalumino Phosphate) resin combined with a generic fiber system such as, but not limited to, Alumina, Altex, Nextel 312, Nextel 440, Nextel 510, Nextel 550, Silicon Nitride, Silicon Carbide, HPZ, Graphite, Carbon, and Peat. To add additional toughness qualities to the material, the fiber system can be first coated to 0.1–5.0 microns thickness with an interface material such as, but not limited to, Carbon, Silicon Nitride, Silicon Carboxyl, Silicon Carbide or Boron Nitride or a layered combination of one or more of the above interfacial materials. The interface material prevents the resin from adhering directly to the fibers of the fiber system. Thus, when the resin is converted to a ceramic matrix, there is a slight play between the ceramic and fibers imparting the desired qualities to the final FRCMC material. Additionally, it is recommended that the surface of the FRCMC head or headliner which faces the combustion environment (cylinder bore) be coated with a wear-resistant coating for resisting corrosive materials of the combustion via commercially available errosion-resistant coatings, such as plasma sprayed alumina powder or physical vapor deposition of a titanium nitrite, or with the conventional plasma spray techniques and of materials identified in the co-pending application entitled REDUCING WEAR BETWEEN STRUCTURAL FIBER REINFORCED CERAMIC MATRIX COMPOSITE AUTOMOTIVE ENGINE PARTS IN SLIDING CONTACTING RELATIONSHIP by the inventors herein, Ser. No. 08/515,926, filed on Aug. 16, 1995 and assigned to the common assignee of this application, the teachings of which are incorporated herein by reference and the above-referenced METHODS AND APPARATUS FOR MAKING CERAMIC MATRIX COMPOSITE LINED AUTOMOTIVE PARTS AND FIBER REINFORCED CERAMIC MATRIX COMPOSITE AUTOMOTIVE PARTS application.

In the cylinder head 10' of FIG. 3, fins 14 are formed integral to the cylinder head 10' itself, thus providing a single FRCMC unit. Additionally, an errosion-resistant coating 28 is applied, via plasma spray techniques, to the combustion facing side of the head to enhance endurance capabilities. The fins 14 are not as breakage resistant as metal fins. Thus, this embodiment is not preferred for most applications.

Figure 4:
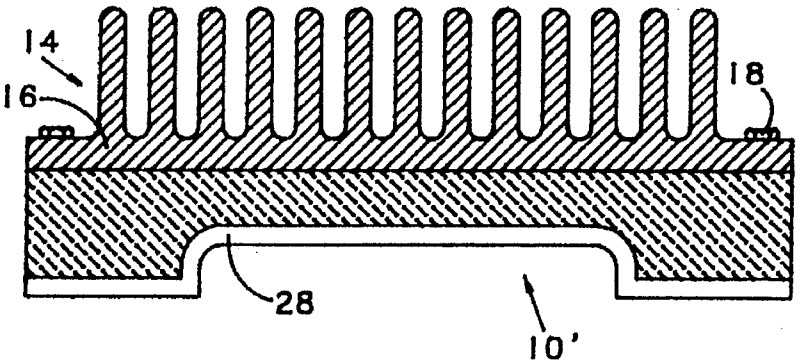
FIG. 4 is a simplified cross section of a ceramic cylinder head with air-cooling fins of metal bolted thereon as an add-on item according to a second embodiment of the present invention.

In the cylinder head 10' of FIG. 4, fins 14 are also employed; but, in this case, they are part of a metal heat sink 16 that is bolted to the top of the cylinder head using the bolts 18 employed to bolt the cylinder head 10' to the engine block. The heat sink 16 and its fins 14 can be welded steel, cast aluminum or iron, or the like, as best suited to the particular application. Additionally, an errosion resistant coating 28 is applied, via plasma spray techniques, to the combustion facing side of the ceramic head to enhance endurance capabilities. This embodiment is preferred for small engine applications such as lawn and garden equipment.

There are three preferred embodiments for the application of the present invention to large powerplants such as those found in motorized vehicles and those used as a stationary power source.

Figure 5:
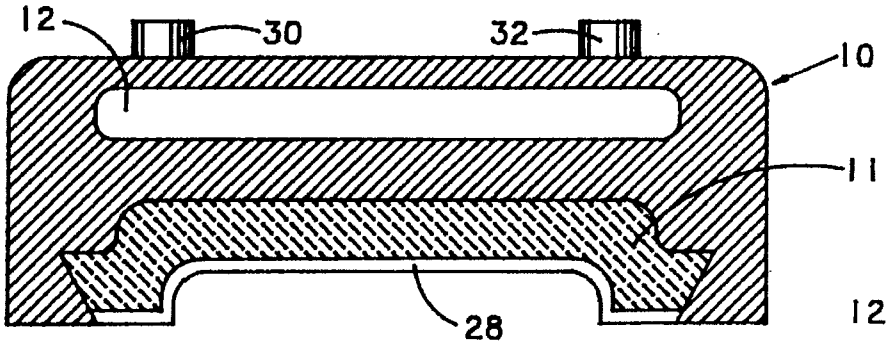
FIG. 5 is a simplified cross section of a ceramic cylinder head incorporated into a cast metal water jacket according to a third embodiment of the present invention.

The first of these is depicted in FIG. 5. The cylinder head 10' is of metal having a metal water jacket 12 cast onto it as well as an integrally cast-in headliner 11. The water jacket 12 has an inlet pipe 30 and an outlet pipe 32 in the usual manner. Since the cylinder head headliner 11 is a ceramic, it can be subjected to molten metal during the casting forming process of the water jacket without harm. Thus in a preferred construction approach, one would first make the ceramic headliner 11. The headliner 11 would then be put into a mold for the water jacket 12 as part of the walls of the mold cavity. By pouring molten metal into the mold, the water jacket 12 would be cast directly onto the cylinder head headliner 11 conforming to the contacting surface for maximum structural integrity. Additionally, an errosion resistant coating 28 is applied, via plasma spray techniques, to the combustion facing side of the head/headliner to enhance endurance capabilities.

Figure 6:
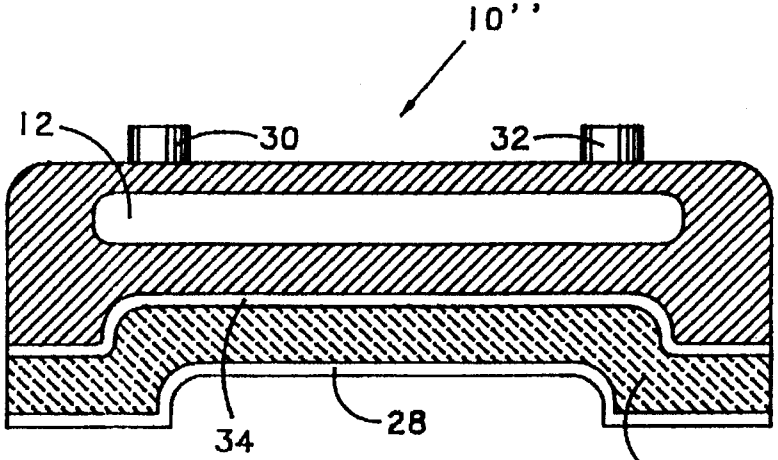
FIG. 6 is a simplified cross section of a ceramic cylinder head incorporated into a cast metal water jacket according to a fourth embodiment of the present invention.

The second of the preferred embodiments is depicted in FIG. 6. The cylinder head headliner 11' is made in the manner described above. A separate, conventional metal head 10" including a water jacket 12 is fabricated using current state-of-the-art techniques with the exception that the combustion chamber region of the head is left oversized with an inner contour which matches the non-combustion chamber facing side contour of the FRCMC headliner. The FRCMC headliner is then adhesively bonded in place using commercially available high temperature adhesives or silicone rubbers 34 including, but not limited to, PERMATEX ULTRA COPPER gasket material. Additionally, an errosion resistant coating 28 is applied, via plasma spray techniques, to the combustion facing side of the FRCMC headliner to enhance endurance capabilities.

Figure 7:
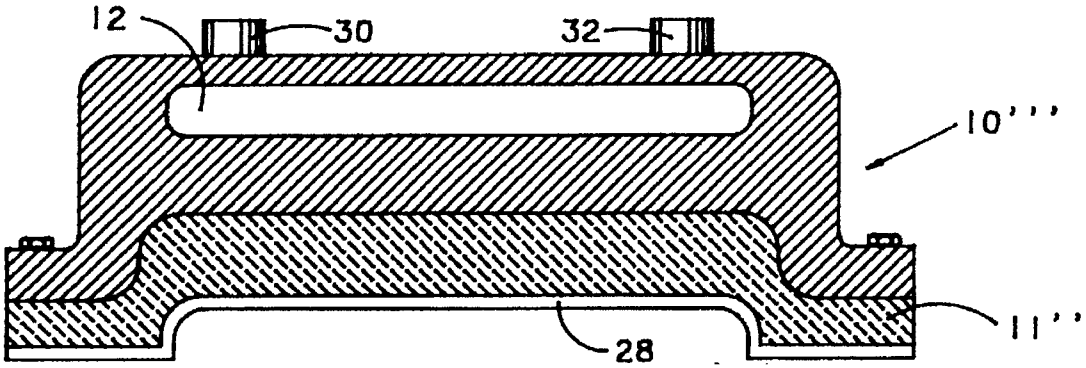
FIG. 7 is a simplified cross section of a ceramic cylinder head incorporated into a cast metal water jacket according to a fifth embodiment of the present invention.

The third of the preferred embodiments is depicted in FIG. 7. The cylinder head headliner 11' is made in the manner previously described. A separate, conventional metal head 10''' including a water jacket 12 is fabricated using current state of the art techniques with the exception that the combustion chamber region of the head is left oversized with-an inner contour which matches the non-combustion chamber facing side contour of the FRCMC headliner 11'. The FRCMC headliner is then mechanically trapped between the cylinder block (not shown) and the conventional metal head 10''' by the use of the headbolts 18 as described above. Additionally, an errosion resistant coating 28 is applied, via plasma spray techniques, to the combustion facing side of the FRCMC head/headliner to enhance endurance capabilities.

EXAMPLE

Fabrication of a FRCMC Headliner

1. Fabricate or purchase a headliner preform of the requisite size (there are a number of U.S. vendors that weave composite preforms for composite applications) from one the fibers that are identified in the above-referenced co-pending application entitled HIGH EFFICIENCY, LOW-POLLUTION ENGINE. The preform should be made so that when loaded in the mold tool, it takes up between 30% and 70% of the open volume within the closed tool.

2. The preform then has a fiber interface coating applied to it as per industry best practices. The assignee of this application, Northrop Corporation, currently has a number of patents on the application of interface coatings, including U.S. Pat. No. 5,034,181 entitled APPARATUS FOR METHOD OF MANUFACTURING PREFORMS the teachings of which are incorporated herein by reference. Also, Allied Signal or Sinterials are commercial companies which will apply an interface coating as a purchased service.

3. The head-countoured preform is then placed in the headliner-shaped cavity of a mold and the mold closed and sealed around it.

4. The lower feed holes in the mold are connected via flexible tubing with a valve to a container containing Blackglas resin. The upper vent hole is attached via flexible clear tubing with a valve to a vacuum source. Both valves are initially opened to allow the resin to be sucked up through the mold.

5. The container with the Blackglas resin is pressurized above 15 PSI, i.e. above atmospheric pressure, to create a positive pressure tending to force the resin through the mold. When the resin is flowing through the mold with no air bubbles present in the tubing on the vacuum (exit) side, both valves are closed.

6. The mold with the enclosed preform and resin mixture is then heated as per the following cycle:

A) Ramp from ambient to 150° F. at 2.7°/minute

B) Hold at 150° F. for 30 minutes

C) Ramp at 1.7°/minute to 300° F.

D) Hold at 300° F. for 60 minutes

E) Cool at 1.2°/minute until temperature is below 140° F. for part demolding.

It should be noted that there are a variety of heat-up cycle definitions which will create usable hardware and the foregoing is by way of one example only and not intended to be exclusive.

7. Upon cool-down of the mold, the mold is disassembled and the polymer composite component removed from the mold for pyrolysis.

NOTE: The previous seven steps identify a Resin Transfer Molding (RTM) approach to preparing the polymer composite component. Other applicable approaches to create the same part are Hand-Lay-up or Short Fiber Injection. These are all valid Polymer Composite Manufacturing Techniques to be included within the scope and spirit of the present invention and the claims appended hereto. These various techniques are not claimed to be inventive of the inventors herein in and of themselves.

8. The polymer composite component is then pyrolized. In this regard, fabrication of a sealable container, such as a stainless steel box, capable of withstanding 1900° F. is required for the pyrolysis cycle in a standard furnace. In the alternative, an inert gas furnace could be used if available. The box should have two tubing connections, one on the bottom and one on the top to allow the box to be flooded with an inert gas. In this example, the sleeve is placed in the box, the box placed in a standard furnace, stainless steel tubing is connected to the lower connector on the box and to a supply of high purity argon. Any equivalent inert gas could, of course, be used. The argon is allowed to flow into the box, and out the top vent at a rate of 5–10 SCFH for the entire heat cycle, thus assuring the sleeve is totally bathed in an inert environment. The furnace is closed and fired on the following basis:

A) Ramp to 300° F. at 223°/hour

B) Ramp to 900° F. at 43°/hour

C) Ramp to 1400° F. at 20°/hour

D) Ramp to 1600° F. at 50°/hour

E) Hold at 1600° F. for 4 hours

F) Ramp to 77° F. at −125°/hour

Again, there are a variety of heating schedules other than this one, given by way of example only, which will yield usable hardware.

9. Upon cooling, the headliner is removed from the furnace and box and submerged in a bath of Blackglas resin for enough time to allow all air to be removed from the headliner (typically 5 minutes or more). A vacuum infiltration may also be used for this step.

10. Steps 8 and 9 may be repeated, if desired, until the percentage of pores formed in the resin by outgassing is minimized and the strength of the part is maximized (typically five times).

11. The headliner is now ready for pre-wear coating application machining. At this time and prior to the application of the wear coating, all holes (spark plug, valves etc.) are machined (commercial grade diamond cutting tools recommended). Upon the completion of the machining processes, all sharp edges on the surface of the headliner are knocked down using diamond paper.

12. The headliner is placed in an oven for a time and temperature adequate to assure "burn off" of any of the cutting lubricants used in the machining process. (Typically 2 Hrs @ 700° F., but is lubricant dependent)

13. The combustion chamber side of the headliner is grit-blasted using a grit and pressure adequate to remove any loose matrix material and expose the fibers within the FRCMC. (Typically 100 grit @ 20 PSI).

14. The headliner is cleaned by using clean dry compressed air.

15. The headliner is then loaded in a holding fixture for the plasma spray process.

16. Direct air blowers are used to cool the non-combustion chamber side of the headliner.

17. The plasma sprayed wear coating (from the list of possibles in the above-referenced co-pending applications)

is then applied using a deposition rate set to 5 grams per minute or more. The holding fixture rotational speed, plasma gun movement rate across the surface, and spray width are set to achieve a barber pole spray pattern with 50% overlap. The spray gun is set relative to the sprayed surface from 0.1 inches to 3 inches away. Particle sizes used for this process range from 170 to 400 mesh. Enough material is applied to allow for finish machining.

18. After the application of the wear coating, the headliner combustion chamber area is smoothed out with diamond paper or an appropriate form tool (commercial grade diamond tools recommended) to achieve the final inner contour.

19. The headliner can then be bonded to or cast within it's metallic mate as appropriate to the particular embodiment being implemented. After installation with it's mate, the block-mating surface of the headliner is machined flat. In the case of the embodiment of FIG. 7, the headliner is machined flat separately since it is not physically attached to the metal head and water jacket.

Wherefore, having thus described the present invention, what is claimed is:

1. A ceramic cylinder head for an internal combustion engine comprising:

a) a cylinder head comprised of a generic fiber system having disposed throughout a pre-ceramic polymer resin in its ceramic state where said pre-ceramic polymer resin consists of a polymer-derived ceramic resin; and, b) means for transferring heat away from a top surface of the cylinder head to maintain the cylinder head below a threshold temperature.

2. The ceramic cylinder head of claim 1 wherein said means for transferring heat away from a top surface of the cylinder head comprises:

radiating fins formed in said top surface of the cylinder head for transferring heat to air surrounding said fins.

3. The ceramic cylinder head of claim 1 wherein said means for transferring heat from a top surface of the cylinder head comprises:

a metal heat sink attached to said top surface, said heat sink including radiating fins for transferring heat to air surrounding said fins.

4. The ceramic cylinder head of claim 1 wherein said means for transferring heat from a top surface of the cylinder head comprises:

a metal water jacket formed onto said top surface, said water jacket having an inlet pipe and an outlet pipe for passing engine coolant therethrough.

5. The ceramic cylinder head of claim 1 wherein said means for transferring heat from a top surface of the cylinder head comprises:

a metal water jacket adhesively bonded or mechanically attached onto said top surface, said water jacket having an inlet pipe and an outlet pipe for passing engine coolant therethrough.

6. The ceramic cylinder head of claim 1 wherein:

said means for transferring heat from a top surface of the cylinder head includes means for heating a fluid used in a passenger compartment heating system.

7. The ceramic cylinder head of claim 1 and additionally comprising:

an errosion-resistant coating disposed over a combustion facing side of said cylinder head whereby endurance capabilities of the cylinder head are enhanced.

8. A ceramic cylinder head for an internal combustion engine comprising:

a) a cylinder head made of a generic fiber system having disposed throughout a pre-ceramic polymer resin in its ceramic state where said pre-ceramic polymer resin consists of a polymer-derived ceramic resin; and, b) a metal water jacket formed onto a top surface of said cylinder head, said water jacket having an inlet pipe and an outlet pipe for passing engine coolant therethrough to maintain the cylinder head below a threshold temperature.

9. The ceramic cylinder head of claim 8 and additionally comprising:

an errosion-resistant coating disposed over a combustion facing side of said cylinder head whereby endurance capabilities of the cylinder head are enhanced.

10. A ceramic cylinder head for an internal combustion engine comprising:

a) a cylinder head made of a generic fiber system having disposed throughout a pre-ceramic polymer resin in its ceramic state where said pre-ceramic polymer resin consists of a polymer-derived ceramic resin; and, b) a metal water jacket adhesively bonded or mechanically attached to a top surface of said cylinder head, said water jacket having an inlet pipe and an outlet pipe for passing engine coolant therethrough to maintain the cylinder head below a threshold temperature.

11. The ceramic cylinder head of claim 10 and additionally comprising:

an errosion-resistant coating disposed over a combustion facing side of said cylinder head whereby endurance capabilities of the cylinder head are enhanced.

12. A ceramic lined cylinder head for an internal combustion engine comprising:

a) a cylinder liner head liner having a combustion facing side and being of a generic fiber system having disposed throughout a pre-ceramic polymer resin in its ceramic state where said pre-ceramic polymer resin consists of a polymer-derived ceramic resin; and, b) a metal cylinder head disposed over a top surface of said cylinder head liner, said metal cylinder head including means for transferring heat away from said top surface of said cylinder head liner to maintain the cylinder head below a threshold temperature.

13. The ceramic lined cylinder head of claim 12 wherein said means for transferring heat away from said top surface of said cylinder head liner comprises:

radiating fins formed in a top surface of said metal cylinder head for transferring heat to air surrounding said fins.

14. The ceramic lined cylinder head of claim 12 wherein said means for transferring heat away from said top surface of said cylinder head liner comprises:

a metal heat sink attached to a top surface of said metal cylinder head, said metal heat sink including radiating fins for transferring heat to air surrounding said fins.

15. The ceramic lined cylinder head of claim 12 wherein said means for transferring heat away from said top surface of said cylinder head liner comprises:

a metal water jacket formed into said metal cylinder head, said water jacket having an inlet pipe and an outlet pipe for passing engine coolant therethrough.

16. The ceramic lined cylinder head of claim 12 wherein:

said means for transferring heat away from said top surface of said cylinder head liner includes means for heating a fluid used in a passenger compartment heating system.

17. The ceramic lined cylinder head of claim 12 and additionally comprising:

an errosion-resistant coating disposed over said combustion facing side of said cylinder head liner whereby endurance capabilities of the cylinder head liner are enhanced.

* * * * *